US006676755B2

(12) United States Patent
Ehrenleitner et al.

(10) Patent No.: US 6,676,755 B2
(45) Date of Patent: Jan. 13, 2004

(54) INSTALLATION FOR TREATING, ESPECIALLY PAINTING, OBJECTS, ESPECIALLY VEHICLE BODIES

(75) Inventors: Franz Ehrenleitner, Stuttgart (DE); Hans-Joachim Weinand, Dietzingen (DE)

(73) Assignee: Eisenmann Maschinenbau KG (DE)

( * ) Notice: Subject to any disclaimer, the term of this patent is extended or adjusted under 35 U.S.C. 154(b) by 0 days.

(21) Appl. No.: 10/239,998

(22) PCT Filed: Sep. 14, 2001

(86) PCT No.: PCT/EP01/10613

§ 371 (c)(1),
(2), (4) Date: Sep. 26, 2002

(87) PCT Pub. No.: WO02/060598

PCT Pub. Date: Aug. 8, 2002

(65) Prior Publication Data

US 2003/0056723 A1 Mar. 27, 2003

(30) Foreign Application Priority Data

Jan. 29, 2001 (DE) ..... 101 03 837

(51) Int. Cl.[7] ..... B05C 3/00

(52) U.S. Cl. ..... 118/423; 104/94

(58) Field of Search ..... 104/94, 243; 105/155; 198/346.3, 375, 377.02; 134/116; 118/416, 423, 425, 426, 500; 204/198, 199, 479, 625

(56) References Cited

FOREIGN PATENT DOCUMENTS

| | | |
|---|---|---|
| DE | 44 10 477 C1 | 9/1995 |
| DE | 196 41 048 C2 | 7/2000 |
| DE | 198 48 946 C2 | 8/2000 |
| DE | 201 05 676 U1 | 8/2001 |
| JP | 5-193715 | 8/1993 |

*Primary Examiner*—Brenda A. Lamb
(74) *Attorney, Agent, or Firm*—Factor & Partners

(57) ABSTRACT

Objects, (4) especially vehicle bodies (4), are guided through a painting installation comprising at least one bath (2) in a continuous translation movement, by means of a transport device (5). Immersion devices carry the objects using a carrier structure (61) which is connected to the transport device (5) in such a way that it can be pivoted by a pivoting arm (50, 51). A first drive device (54, 55, 56, 57) causes a pivoting movement of the pivoting arm (50, 51) about a first axis. A second drive device (78, 79, 80, 81) is used to pivot the carrier structure (61) about the second axis, in relation to the pivoting arm (50, 51). One such immersion device enables very different kinematics of the immersing and emerging movement to be carried out.

8 Claims, 10 Drawing Sheets

INSTALLATION FOR TREATING, ESPECIALLY PAINTING, OBJECTS, ESPECIALLY VEHICLE BODIES

The invention relates to an installation for treating, in particular for painting, objects, especially vehicle bodies, comprising a) at least one bath containing a treatment liquid, in particular a paint, in which the objects are to be immersed;

b) a conveying device by means of which the objects can be transported in a continuous or intermittent translation movement through the installation;

c) a plurality of immersion devices that in each case carry an object on a supporting structure joined via a connecting structure to the conveying device and that are able to immerse the said object in the bath.

Such an installation is described in DE 196 41 048 C2. In this installation the immersion devices are designed so that the objects to be treated, in the illustrated embodiment car bodies to be painted, are immersed in the baths by a combination of the translation movement and a rotational movement about an axis aligned perpendicular to the transportation direction and are then removed from the baths. The connecting structures of these immersion devices are in this connection rigid holding frames comprising, in the normal position in the lower and middle regions, a single rotational axis for the rotational movement. The rationale of this arrangement is to be able to immerse completely in the baths, in a relatively short path of the translation movement, the objects to be treated, with the result that the front walls of the baths may be steep and the baths overall may be short. The disadvantage is that the objects to be treated have to be turned completely upside down. This requires very complicated holding frames and large forces in the case of objects of considerable weight. When the objects to be treated are vehicle bodies their movable parts, for example doors, luggage boots and bonnets, have to be secured so they cannot open. Furthermore these known immersion devices permit only a single kinematics of the immersion movement, specifically just the rotational movement, which is not ideal for many objects that have unfavourable geometries in this regard.

The object of the present invention is to modify and improve an installation of the type mentioned in the introduction, so that by using substantially identically short baths a rotation of the objects to be treated by 180° is not necessary and the kinematics of the immersion procedure can optionally be varied.

This object is achieved according to the invention if d) the connecting structure comprises at least one pivoting arm that is coupled to the conveying device about a first axis, and a drive device associated with the pivoting arm by means of which the said pivoting arm can be swivelled;

e) the supporting structure is swivellably coupled to the pivoting arm about a second axis that is spaced from the first axis, and f) a drive device is provided by means of which the supporting structure can be swivelled about the second axis relative to the pivoting arm.

According to the invention a double swivelling possibility is thus provided within the connecting structure included in each immersion device: on the one hand the pivoting arm itself swivels relative to the conveying device, and on the other hand the supporting structure swivels relative to the pivoting arm. Both swivelling movements may be performed independently of one another by in each case a separate drive device. By suitably coordinating the two drive devices it can also be ensured that the object retains its orientation relative to the horizontal or vertical during a swivelling movement of the pivoting arm. The installation according to the invention enjoys particular flexibility if the two pivoting degrees of freedom are coupled with a suitable linear movement of the conveying system.

Conveniently the drive device for the swivelling movement of the supporting structure relative to the pivoting arm should be arranged at a position that does not dip into the bath when the pivoting arm is swivelled, and should be connected to the said supporting structure via a mechanical adjustment device. The treatment liquids within the baths, including paints, may be so aggressive that the drive device should not be exposed to these treatment liquids. The adjustment devices on the other hand may be made to be so resistant that they do not suffer any damage due to the treatment liquid.

It is particularly preferred in this regard if the adjustment device comprises a track arrangement. Not only can considerable forces be transmitted via such a track arrangement, but the latter operates robustly and reliably also in an environment in which substances may form deposits thereon. Deposits that have become encrusted may be removed without any difficulty by such a track arrangement.

It is particularly advantageous if the adjustment device comprises two bars that are on the one hand coupled to a part rigidly connected to the supporting structure and on the other hand are coupled to a part rigidly connected to the output shaft of the drive device, so that they never simultaneously reach a dead point. In this way pivoting angles that are greater than 180° can be produced without any problem.

In principle the mechanical adjustment device may however also comprise a conventional chain system.

An advantageous embodiment of the invention is characterised in that the output shaft of the drive device of the pivoting arm is hollow and the output shaft of the drive device for the swivelling movement of the supporting structure passes coaxially through the output shaft of the drive device of the pivoting arm. This type of structure is particularly economical as regards space.

The pivoting arm conveniently carries a counterbalance weight so that the torque required to swivel the pivoting arm can be kept very small.

A similar objective is pursued in the design of the invention in which the pivoting arm co-operates with an energy storage device that is able to store in the meantime energy released in the reverse movement of the end of the pivoting arm connected to the supporting structure, in order to give back this energy during the forward movement of the pivoting arm.

One embodiment of the invention is described in more detail hereinafter with the aid of the drawings, in which.

Figure 1:
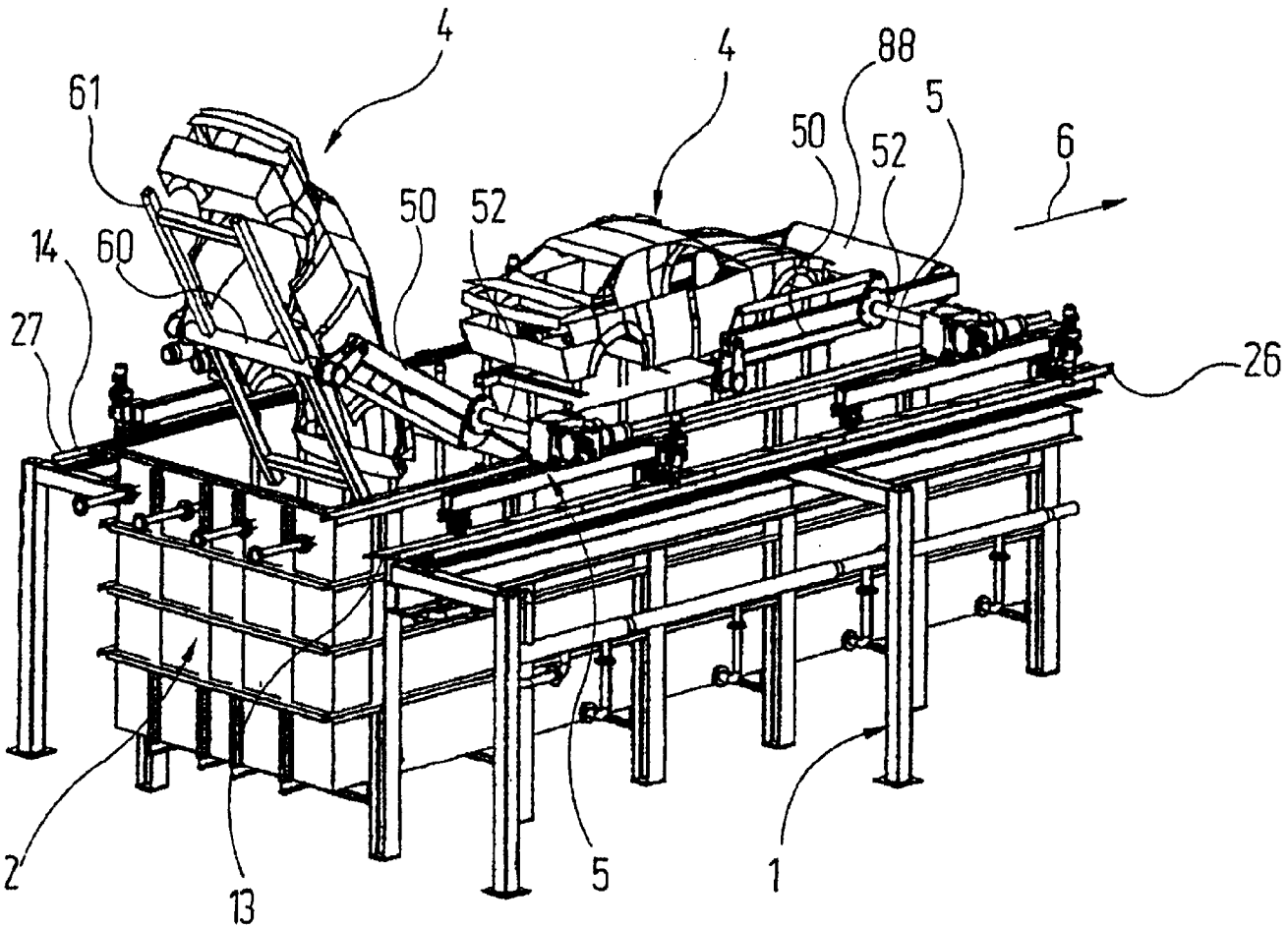
FIG. 1 is a perspective section of a dip-coating installation for vehicle bodies.

The dip-coating installation for vehicle bodies illustrated in the drawing comprises a steel structure 1 having a plurality of vertical supports and horizontal bearers in which a bath holder 2 is suspended. The bath holder 2 is filled up to a certain level with liquid paint, in which vehicle bodies 4 are to be immersed. These vehicle bodies 4 are for this purpose transported with the aid of individual transporting carriages 5 in the direction of the arrow 6 (c.f. FIG. 1), this translation movement of the individual transporting carriages 5 being able to be effected independently of one another, and in the course of these independent movements decelerations, accelerations, stops and also reversing movements are possible. Overall however the transportation of the vehicle bodies 4 takes place in the direction of the arrow 6 of FIG. 1.

The exact mode of construction of the transporting carriages 5 is illustrated in more detail in FIGS. 4 to 10. As can be seen in particular in FIGS. 6 and 7, each transporting carriage 5 has two longitudinal arms 7, 8 on the lower side of which in each case two double wheels 9, 10 and 11, 12 are rotatably mounted about a horizontal axis. In addition the wheels 9 to 12 may in each case be rotated about a vertical axis with the aid of a rotating stool (not shown in detail), so that the alignment of the double wheels 9 to 12 relative to the respective longitudinal arms 7, 8 can be altered.

Figure 2:
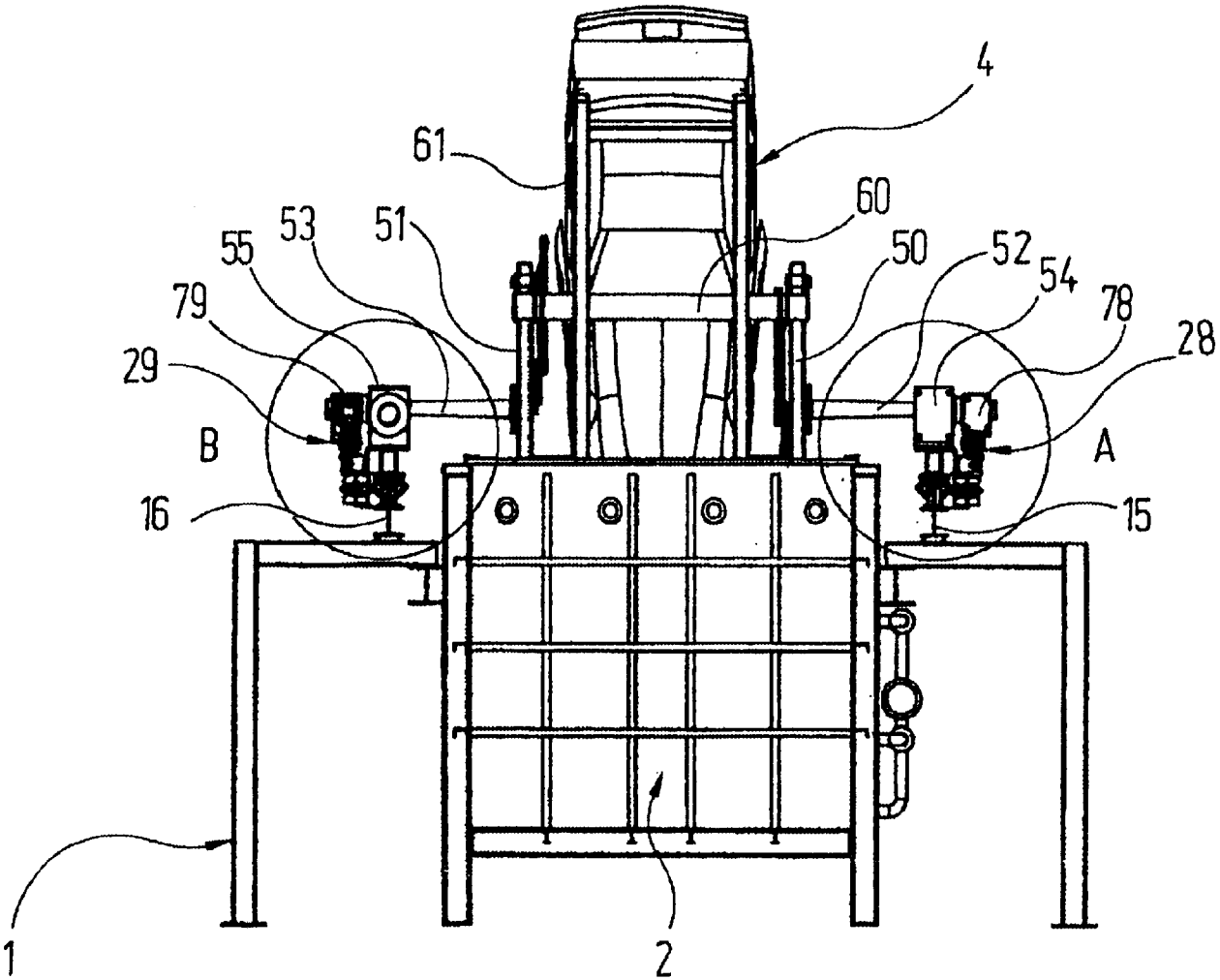
FIG. 2 is a section through the installation of FIG. 1 perpendicular to the movement direction of the vehicle bodies, seen from the lower left-hand side.
Figure 3:
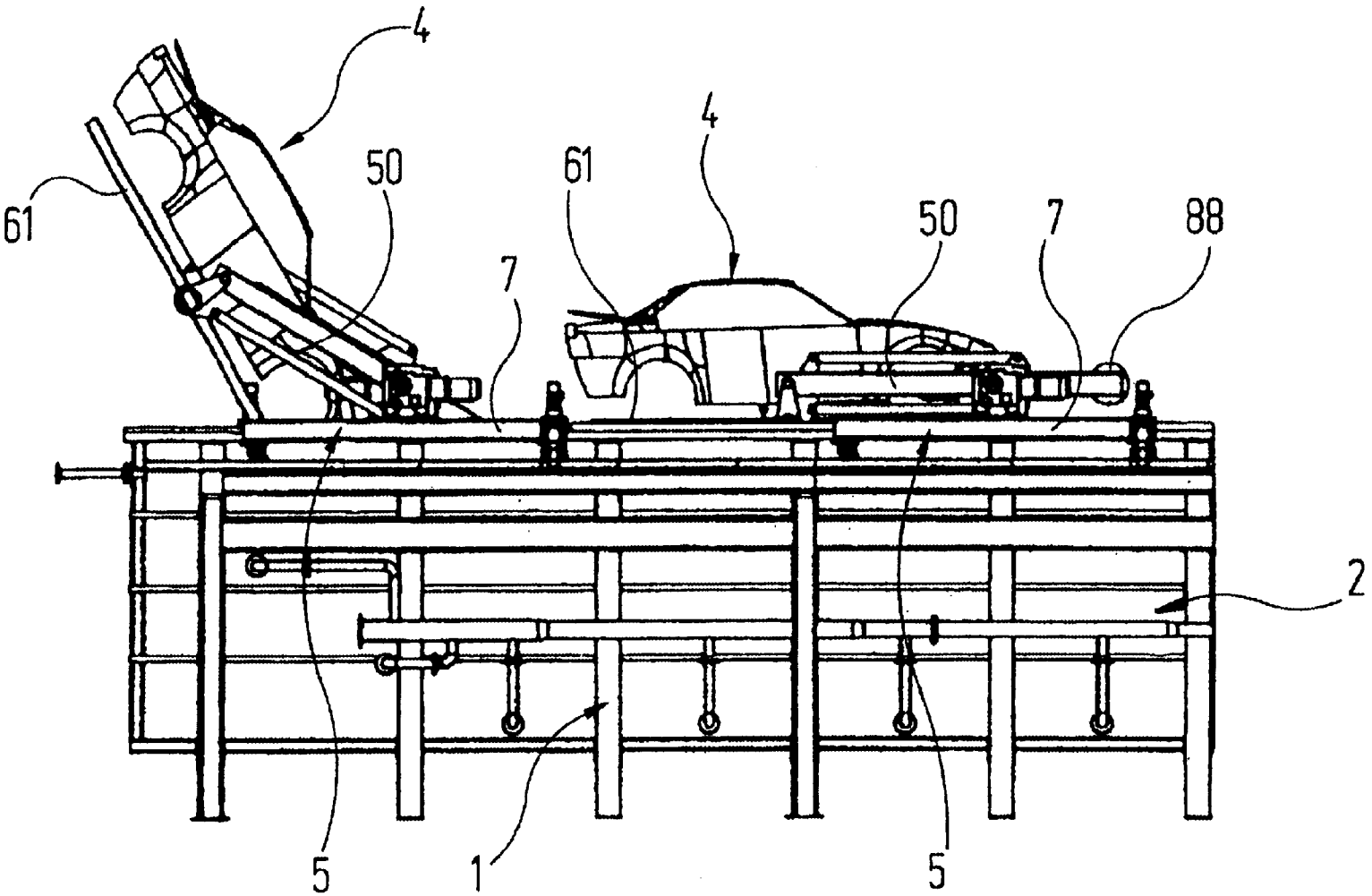
FIG. 3 is a side view of the section of the painting installation of FIG. 1.

The double wheels 9, 10 roll on a first running surface 13 and the double wheels 11, 12 roll on a second running surface 14 parallel thereto. The running surfaces 13, 14 are for their part mounted in each case on an I-shaped bearer 15, 16 that is supported by the steel structure 1 (see in particular FIG. 2).

Figure 6:
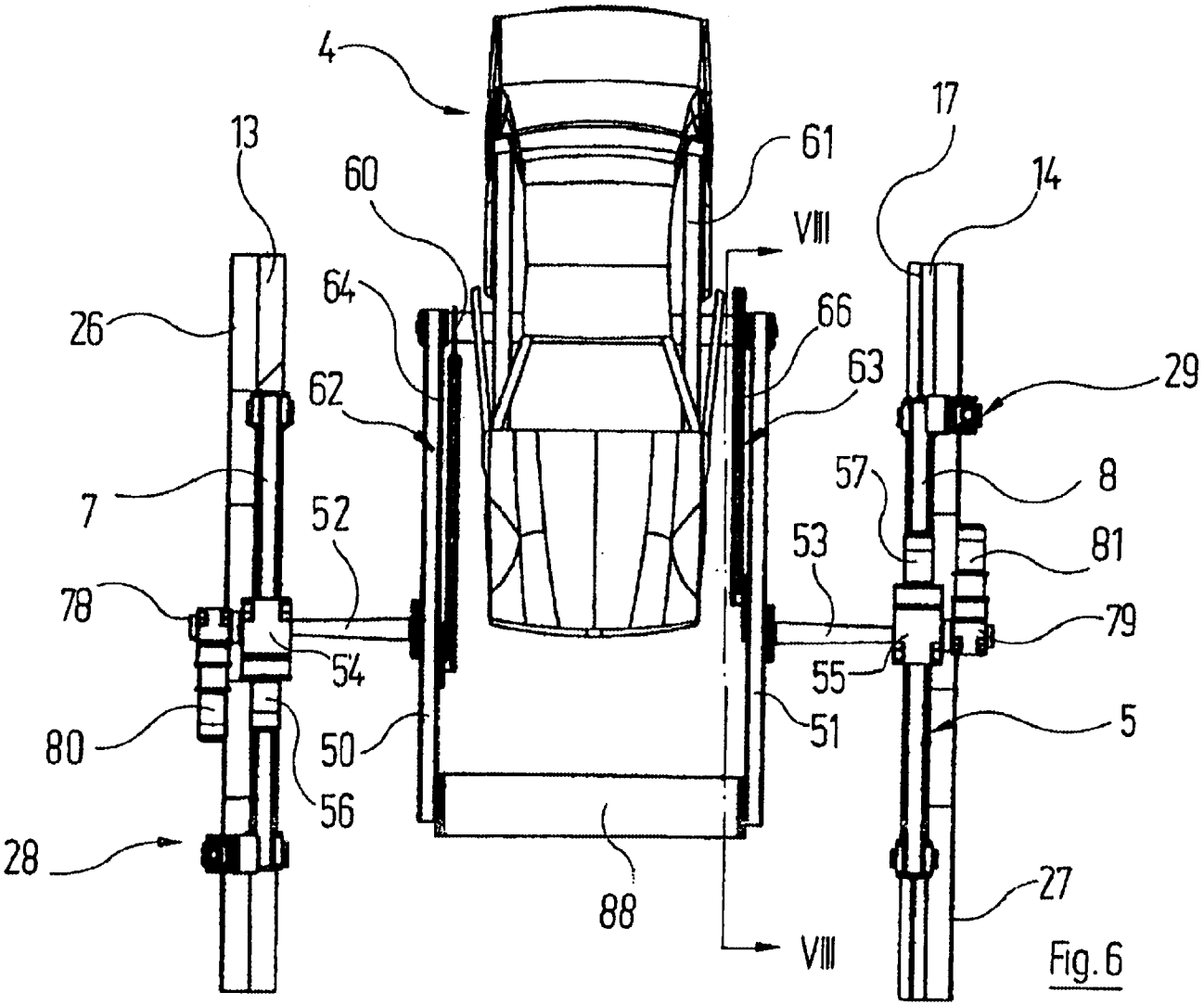
FIG. 6 is a view from above of the transporting carriage of FIG. 5.
Figure 7:
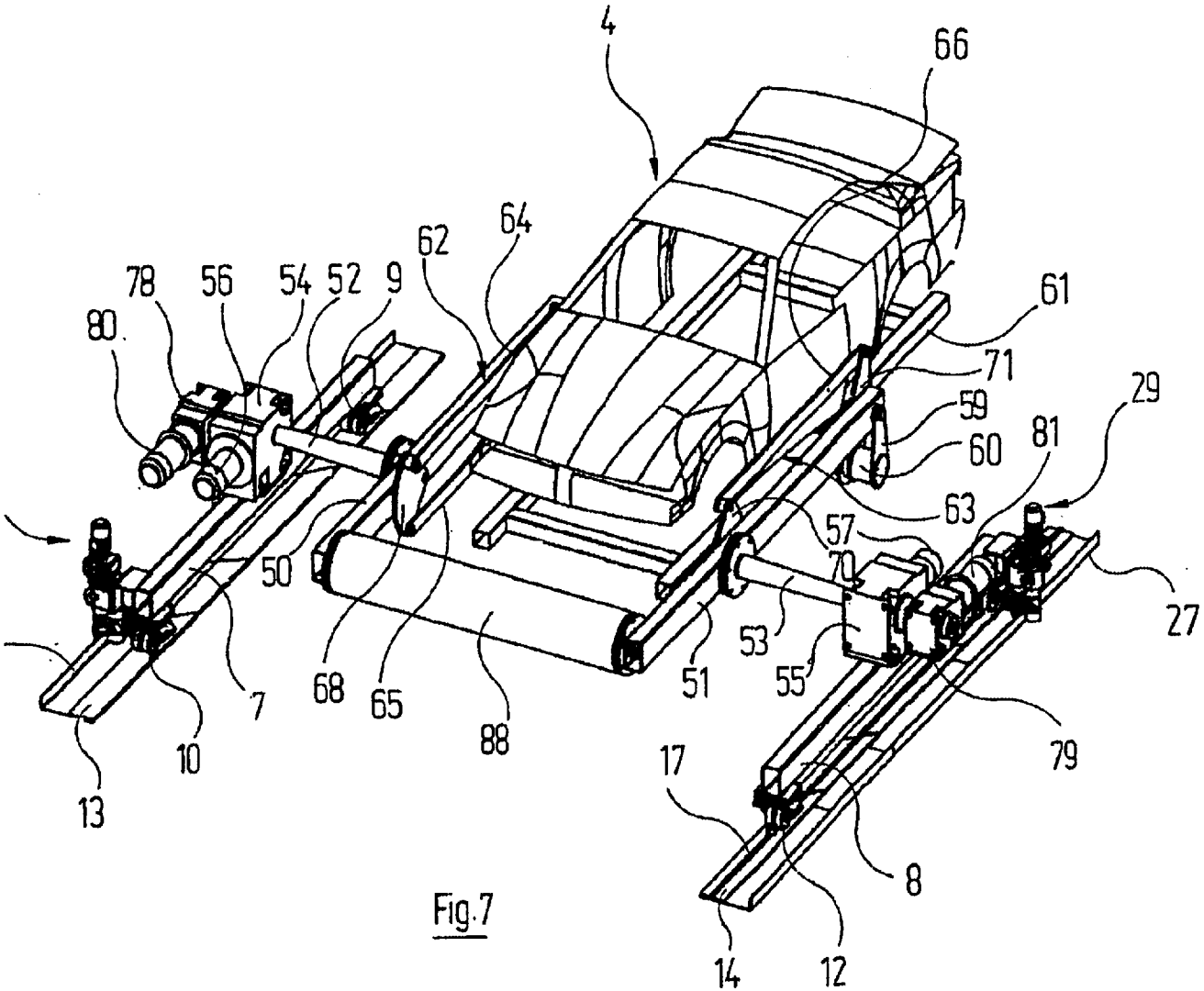
FIG. 7 is a perspective view of the transporting carriage together with the vehicle body of FIG. 4.
Figure 8:
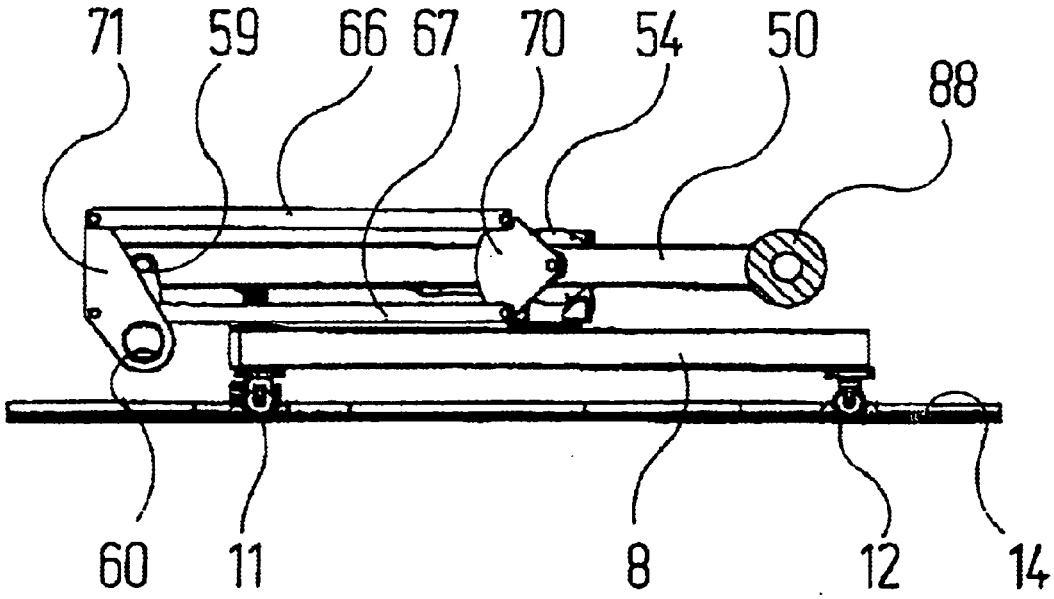
FIG. 8 is a section through FIG. 6 along the line VIII—VIII shown there.
Figure 9:
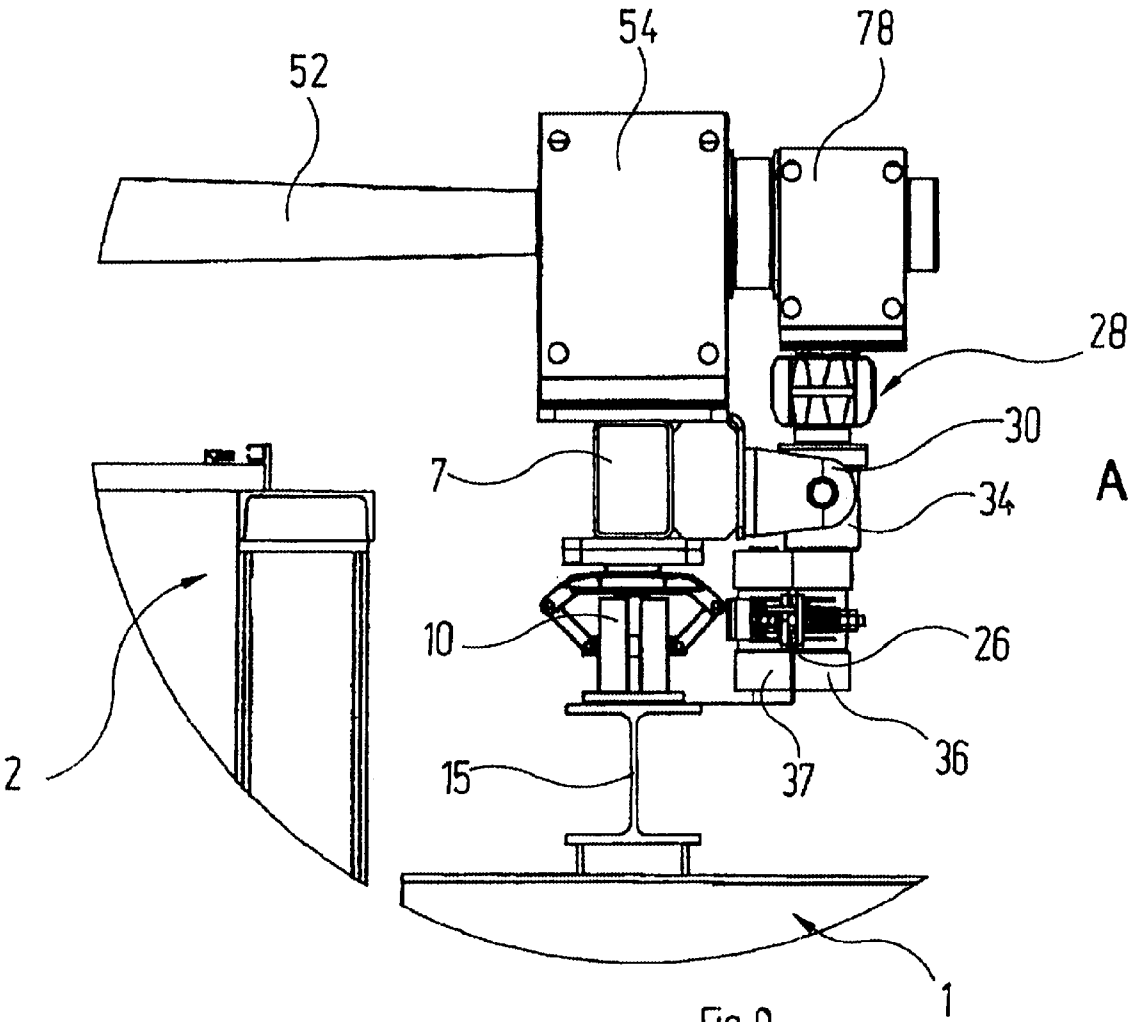
FIG. 9 is an enlarged detailed view of the region of the circular section of FIG. 2 identified by the reference letter A.
Figure 10:
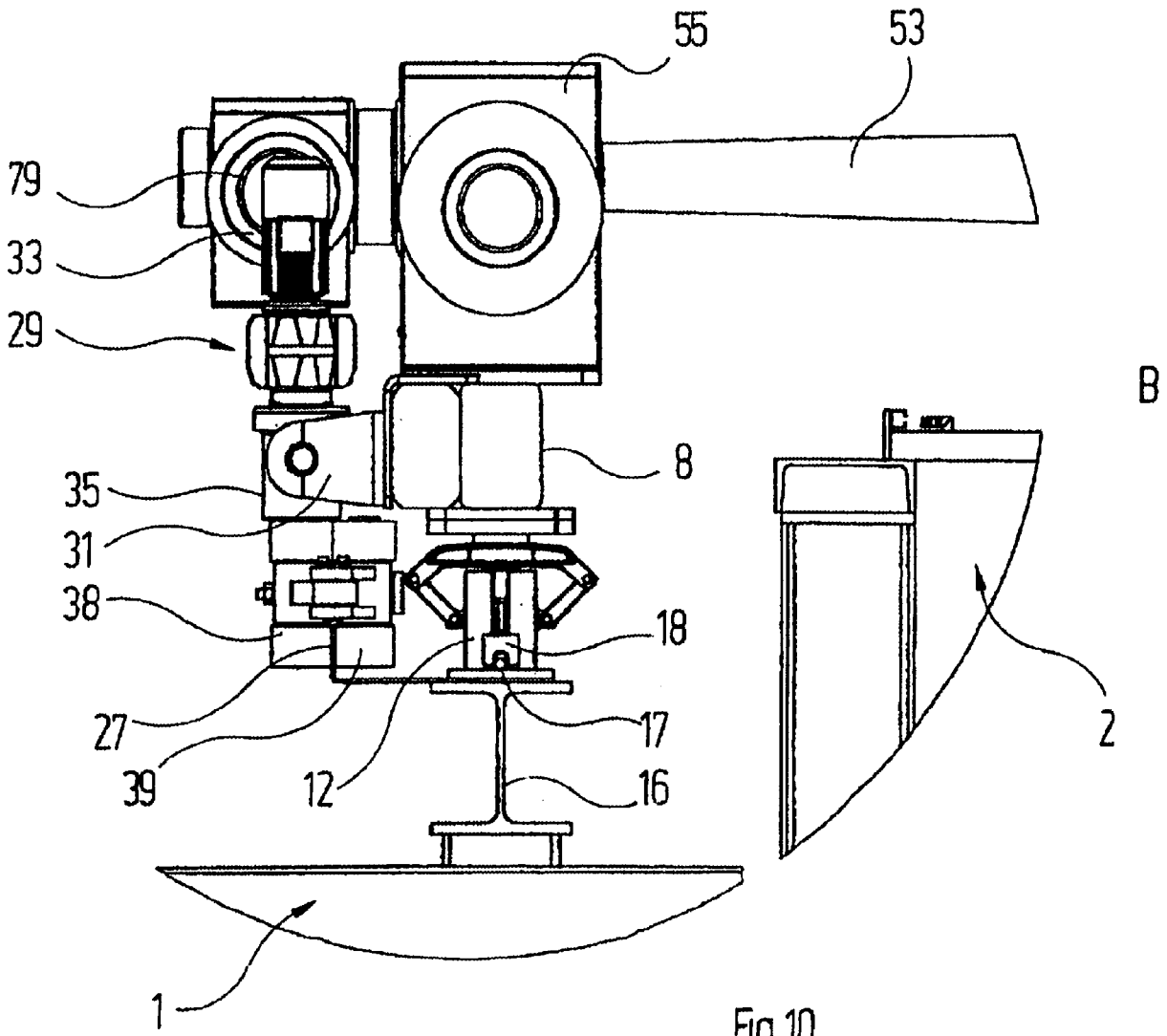
FIG. 10 is an enlarged detailed view of the region of the circular section of FIG. 2 identified by the reference letter B.

A guide rib 17 that is overlapped by guide members 18 having a complementary recess (see FIG. 10) is mounted in the middle of the second running surface 14 shown on the right-hand side of FIGS. 6 and 7. In each case a guide member 18 is joined to the rotating stool of an associated double wheel 11, 12 so that it rotates this double wheel 11, 12 about the vertical axis, corresponding to the course of the guide rib 17. In this way the double wheels 11, 12 follow the running surface 14. The double wheels 9, 10 associated with the first running surface 13 shown on the left-hand side of FIGS. 6 and 7 are designed on the other hand simply as after-running (lagging) wheels; this means that no separate guide means are provided for influencing the angular setting of the wheels about their vertical axis of rotation. In this way the accuracy requirements on the guide means by means of which the transporting carriages 5 are held on the running surfaces 13, 14 can be kept low.

The vehicle bodies 4 are carried on the transporting carriages 5 by means of an immersion device that on both sides of the vehicle bodies 4 includes in each case a pivoting device. Each of these pivoting devices has a pivoting arm 50, 51 that can swivel, in a manner still to be described, in a vertical plane that runs parallel to the conveying direction. For this purpose each pivoting arm 50, 51 is joined to the output shaft of a drive 54, 55 via a stub shaft 52, 53 running perpendicular to the conveying direction. The drive 54, 55 is secured to the respective longitudinal arm 7, 8 of the transporting carriage 5 roughly in its middle region. The drive is operated by a motor 56, 57 that is flanged laterally onto the drive 54, 55.

Figure 4:
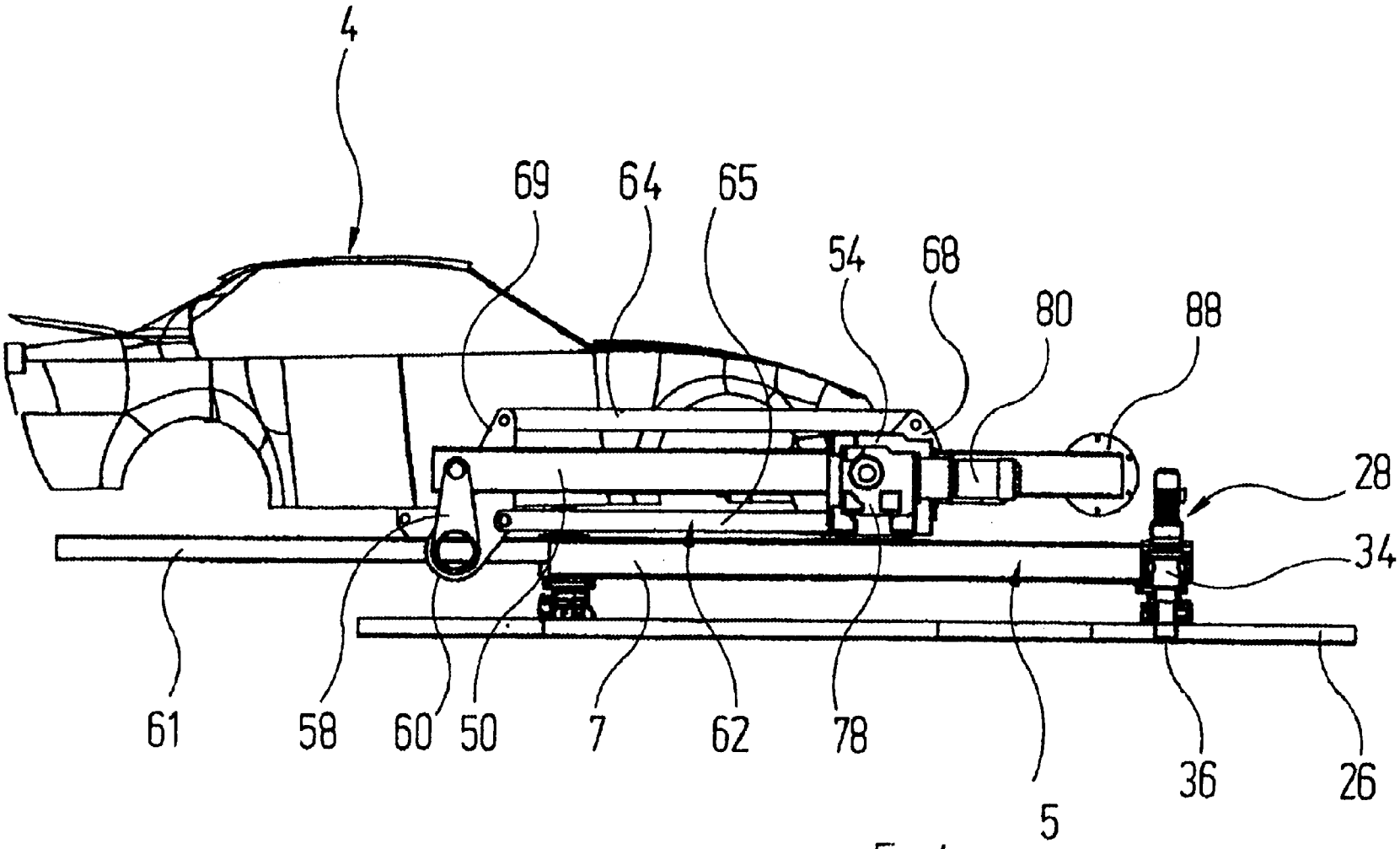
FIG. 4 is a side view of a transporting carriage that is used in the painting installation, with a vehicle body in the normal transporting position secured thereto.
Figure 5:
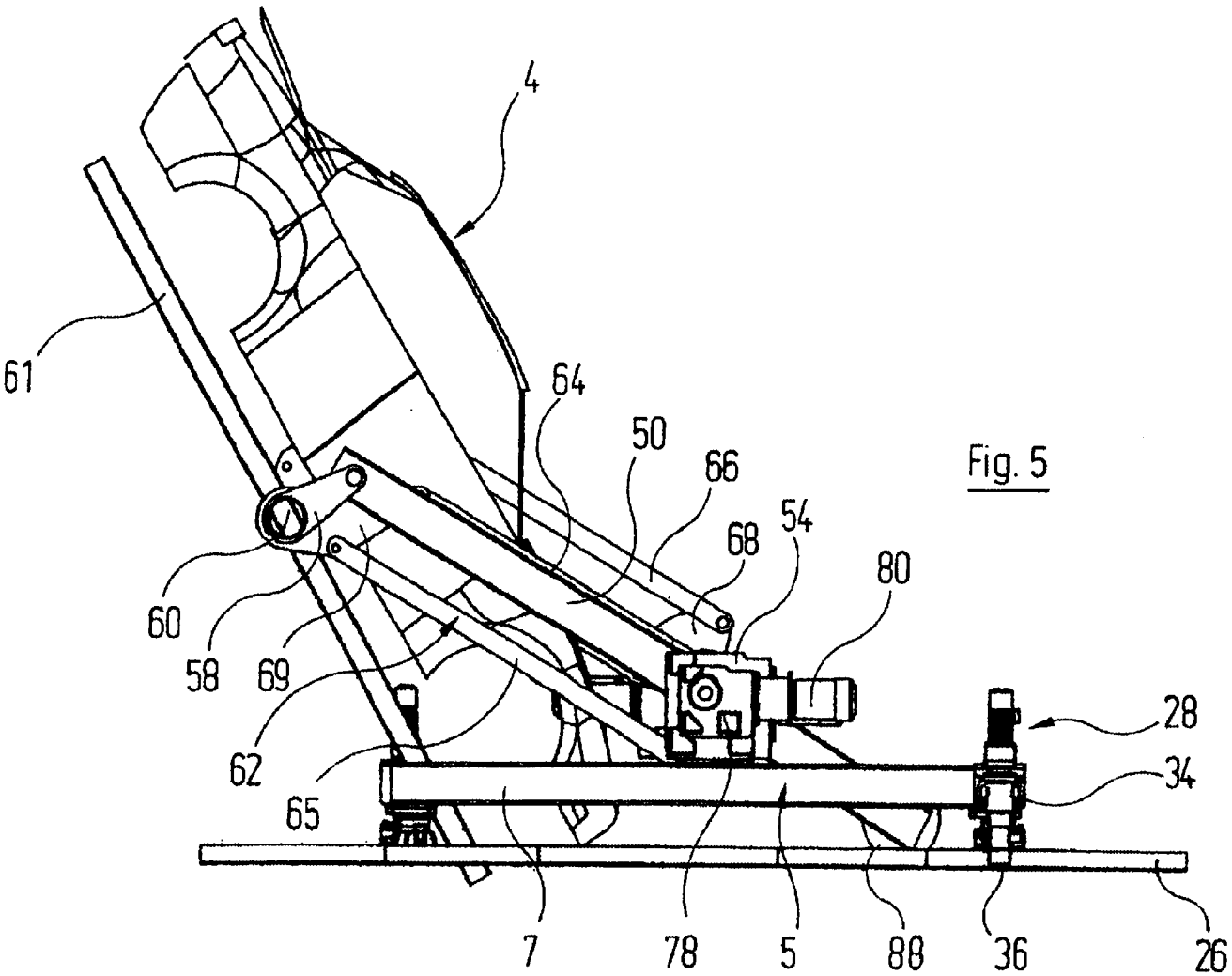
FIG. 5 is a side view of the transporting carriage similar to FIG. 4, in which the vehicle body is however swivelled from the transporting position for immersion in a bath or removal from the bath.

The rear ends of the pivoting arms 50, 51 seen in the movement of direction are articulatedly joined to a splice plate 58, 59 that extends vertically downwardly from the corresponding pivoting arm 50, 51, in the normal transporting position illustrated in FIG. 4. The lower ends of the splice plates 58, 59 are connected to one another via a transverse arm 60 running perpendicular to the movement of direction, which arm for its part is rigidly connected to the middle region of a supporting platform 61 for the vehicle body 4. The extension direction of the two splice plates 58, 59 runs in this connection perpendicular to the plane of the supporting platform 61.

The angular setting that the splice plates 58, 59 adopt relative to the pivoting arms 50, 51 is determined in each case by an adjustment device that is identified overall by the reference numerals 62, 63. Each of these adjustment devices 62, 63 comprises a track arrangement with two parallel thrust rods 64, 65 and 66, 67 that are joined to one another at their opposite ends in each case by a connecting plate 68, 69 and 70, 71. The rear connecting plates 69, 71 seen in the direction of movement are rigidly connected at their lower end to the transverse arm 60.

The front connecting plates 70, 71 seen in the direction of movement are on the other hand rigidly connected in each case to a stub shaft, which cannot be recognised in the drawing since it passes coaxially through the associated stub shaft 52, 53 formed as a hollow shaft. These further stub shafts also run through the drive 54, 55 and are coupled to the output shafts of further drives 78, 79 that are secured laterally to the drives 54, 55. Drive motors 80, 81 are also flanged onto the drives 78, 79.

The front ends of the two pivoting arms 50, 51 together carry a counterbalance weight 88 so that the torques acting on the stub shafts 52, 53 roughly balance out when the vehicle body 4 is mounted in position.

The double wheels 19 to 12 of the transporting carriage 5 are themselves not driven. The forward drive of the transporting carriage 5 is instead performed by a separate drive that will be described in more detail hereinafter with the aid of FIGS. 5 to 10.

Two perpendicularly aligned stationary drive flanges 26, 27 extend parallel to the two running surfaces 13, 14. These co-operate in each case with a pressure roller drive 28, 29 that is secured to the lateral surface of the adjoining longitudinal arm 7, 8 by means of a splice plate 30, 31. The pressure roller drives 28, 29 comprise in each case an electric drive motor 32, 33 and a drive gear system 34, 35. The latter drives the parallel, vertical axes of two pressure rollers 36, 37 and 38, 39 that are pressed from both sides against the in each case associated drive flange 26, 27. When the drive motors 32, 33 are switched on, the pressure rollers 36, 37 and 38, 39 run on the respective lateral surfaces of the drive flanges 26, 27 and thereby move the transporting carriage 5 forwards on the running surfaces 13, 14.

Each transporting carriage 5 comprises its own carriage control, under whose operation it executes its translational movement along the running surfaces 13, 14 as well as the immersion movement of the vehicle bodies 4.

The overall operation of the dip-coating installation described above is as follows:

The vehicle bodies 4 to be painted are placed in each case on their own transporting carriage 5 and thereby conveyed to the bath 2. When the leading end of a vehicle body 4 has reached the beginning of the bath 2, the carriage control decides whether this vehicle body 4 is to be immersed in this bath 2. If this is in the affirmative, the immersion procedure is initiated. This may be implemented in widely differing kinematic modes with the aid of the aforedescribed pivoting device, as will now be explained in more detail with the aid of FIGS. 4 and 5.

The starting point of the description is FIG. 4 which, as already mentioned, represents the "normal" transporting position of the transporting carriage 5. In this position the pivoting arms 50, 51 as well as the supporting platform 61 and the vehicle body 4 secured thereon run horizontally. It is now assumed that the pivoting arms 50, 51 are swivelled by a certain angle by appropriate supply of current to the motors 56, 57 operating the gear systems 54, 55. The drive motors 80, 81 of the adjustment devices 62, 63 should be powered during this movement so that the splice plates 58, 59 rotate by the same angle. The geometrical relationship of the individual components of these adjustment devices, namely the thrust rods 64, 65, 66, 67 and the connecting plates 68, 69, 70, 71 then does not change relative to the pivoting arms 50, 51. The supporting platform 61 and the vehicle body 4 therefore first of all continue to run parallel to the direction of the pivoting arms 50, 51; they execute the same angle as the swivelling movement of the pivoting arms 50, 51. The supporting platform 61 is thereby raised. The coupling points between the pivoting arms 50, 51 and the rear connecting plates 58, 59 seen in the movement of direction thereby move on circular paths whose diameter corresponds to the distance between these coupling points and the axes of the stub shafts 52, 53.

Instead of the swivelling movement described above, in which the supporting platform 61 and pivoting arms 50, 51 remain parallel, it is possible by means of the adjustment devices 62, 63 to alter the angular position of the connecting plates 58, 59 and thereby the angular position of the supporting platform 61 and vehicle body 4 relative to the pivoting arms 50, 51. This is performed by supplying appropriate power to the drive motors 80 and 81. The front connecting plates 68, 70 seen in the direction of movement are thereby swivelled. The swivelling movement of these connecting plates 68, 70 is transmitted via the thrust rods 64, 65, 66, 67 to the rear connecting plates 69, 71, which leads to a swivelling movement of the supporting platform 61 and vehicle body 4 relative to the pivoting arms 50, 51. In this way it is for example possible to maintain the position of the vehicle body 4 shown in FIG. 5.

Obviously the movements produced by the swivelling of the pivoting arms 50, 51 and by the actuation of the adjustment devices 62, 63 may be carried out simultaneously and may thus be superimposed. The translation movement of the transporting carriage 5 may be superimposed, again independently, on all of this.

A possible movement path for the immersion of a vehicle body 4 in a bath 2 is the following: first of all the transporting carriage 5 is driven sufficiently far over the bath 2 so that the front region of the supporting platform 61 up to roughly behind the connecting plate 71 stands over the bath 2. The supporting platform 61 is now adjusted approximately vertically by supplying appropriate power to the motors 80, 81 operating the adjustment devices 62, 63. The front region of the vehicle body 4 thereby dips into the bath 2 a short distance behind the front wall of the bath 2. The pivoting arms 50, 51, which as before run horizontally, are now pivoted in a counterclockwise direction by means of the electric motors 56, 57 so that the rear ends of the pivoting arms 50, 51 carrying the supporting platform 61 are moved downwards into the bath 2. With this swivelling movement the adjustment devices 62, 63 are at the same time actuated so that the vertical alignment of the supporting platform 61 is maintained. The drives 28, 29 of the transporting carriage 5 are simultaneously activated; during the aforedescribed swivelling movements of the pivoting arms 50, 51 and transporting platform 61, the transporting carriage 5 moves backwards so that the distance between the supporting platform 61 and the adjacent front wall of the bath 2 remains roughly constant. In this way the vehicle body 4 is immersed practically vertically in the bath 2.

When a sufficient immersion depth is reached, the swivelling movement of the pivoting arms 50, 51 is ended. A swivelling movement of the supporting platform 61 back to the horizontal position is now initiated with the aid of the two adjustment devices 62, 63. So that the supporting frame 61 does not touch the adjacent front wall of the bath 2 during this swivelling movement, the transporting carriage 5 is moved linearly by activating the drives 28, 29 so that the rear end of the said supporting frame 61 moves downwardly at a roughly constant distance from the front wall of the bath 2. When the supporting frame 61 has then reached the horizontal position, the adjustment devices 62, 63 are switched off. The vehicle body 4 now moves with the aid of the transporting carriage 5 in a horizontal direction through the bath 2. A "seesaw" motion of the supporting platform 61 may optionally be produced during this movement by appropriately supplying current of opposite polarity to the motors 80, 81 of the adjustment devices 62, 63.

When the transporting carriage 5 has reached the end of the bath 2, the supporting platform 61 is lifted from the bath 2 by a combined swivelling movement of the pivoting arms 50, 51, of the adjustment devices 62, 63 and optionally a superimposed linear movement of the whole transporting carriage 5, and brought to the "normal" transporting position shown in FIG. 4. The movement path may in this connection be reversed in terms of the immersion procedure or may also take place under completely different kinematic conditions.

The translation movement of the transporting carriage 5 may if desired be slowed down or stopped when the vehicle body 4 is immersed.

If necessary the vehicle body 4 above the bath 2 may be brought into different angular positions in order to allow the paint to run and drip off as completely as possible into the associated bath 2 and in this way minimise the entrainment of paint. The translation movement of the transporting carriage 5 is then resumed by actuating the pressure roller drives 28, 29, optionally at higher speed, until the vehicle body 4 has for example reached a following, further bath 3 in the movement direction. The same procedures as have already been described for the first bath 2 can then be repeated there.

Different vehicle bodies 4 that have to be treated in different ways follow one another in succession in specific painting installations. This is possible without any problem using the aforedescribed painting installation. For example, a vehicle body may drive completely over a bath 2; the vehicle body 4 may also be immersed in the bath 2, 3 in question by adopting a combined swivelling and translation movement in the reverse direction.

Since as previously mentioned successive vehicle bodies 4 may be treated in different ways in the baths, different distances may be adjusted between successive transporting carriages 5. These different distances may if desired be evened out again by appropriate acceleration or retardation of successive transporting carriages 5.

A loading station (not shown) on which the individual vehicle bodies 4 are placed on a stationary transporting carriage 5 and secured to the latter is located at the start of the painting installation. In a similar way an unloading station at which the vehicle bodies 4 are removed from a stationary transporting carriage 5 is located at the end of the painting installation. Both the loading and unloading stations may be designed as lifting stations. In the unloading station the emptied transporting carriage 5 is lowered until the running surfaces 13, 14, which continue also in the unloading station, are flush with parallel running surfaces that extend in a lower floor of the steel structure 1 back to the loading station. The empty transporting carriages 5 are brought to the loading station on these running surfaces underneath the baths 2 in the opposite direction of the arrow 6, which may take place at relatively high speed. In the loading station the transporting carriages 5 are hoisted once again to the level of the upper running surfaces 13, 14 and, as previously described, are loaded with new vehicle bodies 4 to be painted.

Obviously the transporting carriages 5 may also be returned in a different way to the starting point of the installation.

As can be seen in particular from FIG. 1, all the conveying technology components of the described painting installation are located to the side of the bath 2 so that the liquid contained in the bath 2 cannot be contaminated by these conveying technology components.

What is claimed is:

1. Installation for treating, in particular for painting, objects, especially vehicle bodies, comprising:

a) at least one bath containing a treatment liquid, in particular a paint, in which objects are to be immersed;

b) a conveying device by means of which the objects can be transported in a continuous or intermittent translation movement through the installation;

c) a plurality of immersion devices that in each case carry an object on a supporting structure joined via a connecting structure to the conveying device and that are able to immerse the said object in the bath, characterized in that;

d) the connecting structure comprises at least one pivoting arm that is coupled to the conveying device about a first axis, and a drive device associated with the pivoting arm by means of which the said pivoting arm can be swivelled;

e) the supporting structure is swivellably coupled to the pivoting arm about a second axis that is spaced from the first axis; and f) a drive device is provided by means of which the supporting structure can be swivelled about the second axis relative to the pivoting arm.

2. Installation according to claim 1, characterized in that the drive device for the swivelling movement of the supporting structure relative to the pivoting arm is arranged at a position in which it does not dip into the bath when the pivoting arms are swivelled, and is connected via a mechanical adjustment device to the supporting structure.

3. Installation according to claim 2, characterized in that the adjustment device has a track arrangement.

4. Installation according to claim 3, characterized in that the adjustment device comprises two rods that are coupled on the one had to a part rigidly connected to the supporting structure, and on the other hand to a part rigidly connected to an output shaft of the drive device so that they never simultaneously reach a dead point.

5. Installation according to claim 2, characterised in that the mechanical adjustment device comprises a chain.

6. Installation according to claim 2, characterized in that an output shaft of the drive device of the pivoting arm is hollow and the output shaft of the drive device for the swivelling movement of the supporting structure passes coaxially through the output shaft of the drive device of the pivoting arm.

7. Installation according to claim 1, characterized in that the pivoting arm carries a counterbalance weight.

8. Installation according to claim 1, characterized in that the pivoting arm co-operates with an energy-storage device that is able to store in meantime energy that is released in a reverse movement of an end of the pivoting arm connected to the supporting structure so as to give the energy back during forward movement of the pivoting art.

* * * * *